United States Patent [19]

Keller

[11] 4,346,529

[45] Aug. 31, 1982

[54] ADVERTISING DISPLAY FOR PICK-UP TRUCKS OR SIMILAR VEHICLES

[76] Inventor: Louis D. Keller, 3638 E. McMillan Rd., Twin Lake, Mich. 49457

[21] Appl. No.: 228,747

[22] Filed: Jan. 27, 1981

[51] Int. Cl.[3] ..... G09F 21/04

[52] U.S. Cl. ..... 40/588

[58] Field of Search ..... 40/590, 591, 588, 524, 40/472

[56] References Cited

U.S. PATENT DOCUMENTS

| | | | |
|---|---|---|---|
| 444,236 | 1/1891 | Rowe | 40/590 |
| 588,783 | 8/1897 | Stafford | 40/590 |
| 643,517 | 2/1900 | Michales | 40/590 |
| 676,821 | 6/1901 | Neumeyer | 40/590 |
| 3,702,033 | 11/1972 | Coleman | 40/590 |
| 3,949,503 | 4/1976 | Waress | 40/591 |

*Primary Examiner*—Gene Mancene
*Assistant Examiner*—Wenceslao J. Contreras
*Attorney, Agent, or Firm*—Varnum, Riddering, Wierengo & Christenson

[57] ABSTRACT

An advertising display (22) for the back of a pick-up truck (28) and the like includes a frame (24) removably secured to the load bed of a pick-up truck (28) and an advertising medium (30) bearing a plurality of advertising messages mounted in a downwardly-sloping fashion on the frame (24), making the advertising (30) visible from the rear of the truck (28). A transparent sheet (62) mounted over the rearwardly-sloping frame (24) provides a protective cover for the advertising medium (30). In one embodiment, the advertising medium (30) includes a roll (31) of advertising material (30) which is mounted to a spool bar (75) on the frame (24). The advertising medium (30) is sequentially displayed along the rearwardly-sloping wall of frame (24) by a manually operated or motor-driven roller bar (79). A guide bar (77) is provided to guide the advertising medium (30) from the spool bar (25) to the roller bar (79). A tension device (90) on the spool and roller bars (75, 79) retains the advertising medium (30) relatively taut. In another embodiment, the advertising medium (30) is displayed on a plurality of prism-shaped blocks (140) mounted on the frame (24), spaced apart and parallel to each other. The advertising medium (30) is secured on a plurality of faces (141) of each block. The blocks (140) can, likewise, be sequentially rotated to present different sets of advertising material.

13 Claims, 12 Drawing Figures

ADVERTISING DISPLAY FOR PICK-UP TRUCKS OR SIMILAR VEHICLES

TECHNICAL FIELD

The invention relates to the mounting of an advertising display onto a frame removably secured to the load bed of a pick-up truck or similar vehicle.

BACKGROUND ART

For many years, it has been common to display advertising materials on buses, taxis, cars or other motor vehicles. The advertisement material is usually placed on the rear or sides of the vehicle. The advertising material is slid into a holder which is fixed in place on the vehicle and visible to other vehicles or passersby.

In U.S. Pat. No. 2,812,605, issued Nov. 12, 1957, a sign is held in place by a body panel which is directly attached to a motor vehicle. The panel has a hinged frame which permits outward swinging movement and a locking lever which secures the frame to the vehicle. Brackets are provided to secure the panel to the trunk of the vehicle.

Some patents disclose advertising materials which are unwound from a roll. For example, U.S. Pat. No. 3,430,374, issued Nov. 15, 1966, discloses a sign displayed on a flexible sheet stored in a rolled condition under spring tension in the interior of the trunk of the vehicle. When the trunk is opened, the sheet is extended so as to secure the sheet to the lower portion of the trunk. In U.S. Pat. No. 505,682, issued Sept. 26, 1893, a roll containing various advertisements is connected to the wheels of a vehicle so as to change the display as the vehicle travels.

U.S. Pat. No. 3,594,934, issued July 27, 1971, discloses a display connected to the rear of a vehicle wherein the sign is contained on a flexible sheet reinforced by rod-like elements. Elastic straps are attached to the ends of the rod-like elements and the straps stretch around the truck or any suitable protuberance at the rear of the vehicle to secure the sign to the vehicle.

DISCLOSURE OF THE INVENTION

According to the invention, a system is provided for advertising from the back of pick-up trucks and the like having a cab and a rear deck with upstanding side walls. A frame has a front, back and opposite sides and is mounted in the rear deck of the truck with the front of the frame adjacent the cab and the back of the frame adjacent the rear portion of the deck. Means are provided for removably mounting the frame to the rear truck deck so that the frame can be easily installed and removed from the truck when the truck is used for other purposes. The front of the frame extends upwardly to a height near the top of the cab and the sides of the frame slope downwardly and rearwardly to a height near the top of the truck deck side walls, thereby defining a sloping rear wall on the frame. A medium bearing a plurality of advertising messages is mounted on the frame for display of one such message along the sloping rear wall of the frame so as to be visible from the rear of the truck. Means are provided for moving the medium within the frame to sequentially display different advertising messages. Desirably, a transparent sheet of material is mounted along the sloping rear wall of the frame to provide a protective cover for the advertising medium.

In one embodiment, the advertising medium comprises a roll of flexible material which is mounted at one end to a first spool journaled in the frame and at another end to a second spool also journaled in the frame. Means are provided for guiding the roll of advertising material between the spools and along the sloping rear wall of the frame. The medium is moved by rotating one of the spools through a power source such as a motor or through a hand crank.

Further according to the invention, the flexible material is tensioned at front and back portions of the sloping rear walls to retain the flexible material relatively taut along the sloping rear wall.

Further according to the invention, means are provided for applying a tension to the rolls on at least one of the spools. A special guide means is provided at the upper front portion of the frame to guide the flexible material through a loop and to apply tension to the flexible material.

In another embodiment, the advertising medium comprises a plurality of trapizoidally shaped, spaced boxes providing a plurality of faces, each of which bears a portion of a different set of advertising message. The boxes are disposed horizontally between the sides of the frame and are journaled in the frame at spaced locations parallel to the sloping rear wall thereof. The journals for the boxes are interconnected and means are provided for selectively maintaining the boxes in a fixed position and for selectively rotating the boxes sequentially to present different sets of advertising messages.

In both embodiments, means are provided on the frame for illuminating the advertising messages.

BRIEF DESCRIPTION OF THE DRAWINGS

The invention will now be described with reference to the accompanying drawings in which.

BEST MODE FOR CARRYING OUT THE INVENTION

Figure 1:
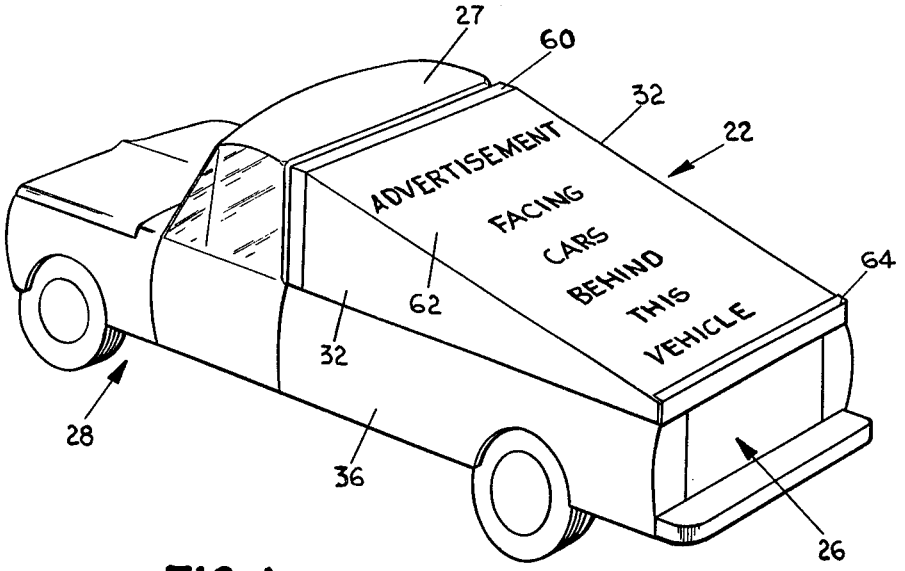
FIG. 1 is a perspective view of the present invention.
Figure 2:
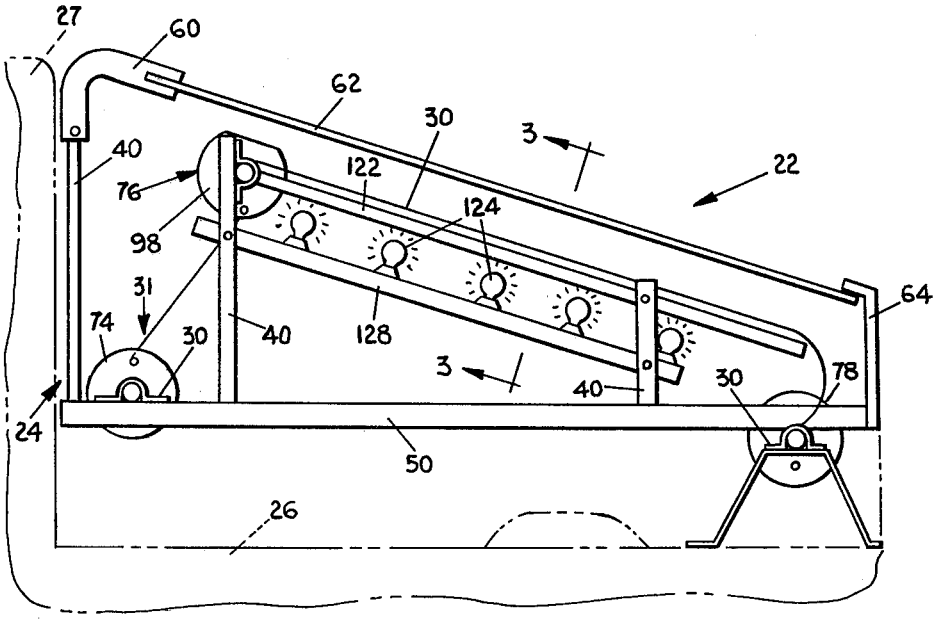
FIG. 2 is a perspective and sectional view of the present invention.

Referring to FIGS. 1 and 2, a conventional pick-up truck 28 having cab and a load bed or rear deck 26 and side walls 36 includes an advertising display 22 mounted to a frame 24. The frame 24 is removably secured to the rear deck 26 of the truck 28 or a similar vehicle. The advertising display 22 including advertising material 30 slopes downwardly with respect to the load bed 26 of the truck 28. In this way, the advertising display 22 is visible to vehicles behind the truck 28. Additionally, advertising material 30 can be mounted to side panels 32 secured to the frame 24. The load bed 26 of the truck 28 remains accessible since the frame 24 supporting the advertising display 22 is placed over the load bed 26 and is removably attached to the side walls 36 of the truck 28.

The frame 24 is constructed of a plurality of vertical supports 40 which are aligned along the sides of the truck 28. The vertical supports 40 are secured to horizontal supports 50 mounted to the side walls 36 of the truck 24. The horizontal supports 50, which extend along the load bed 26, end adjacent the cab 27 of the truck 28. The horizontal supports 50 are preferably wooden 2×4 members whereas the vertical supports 40 are preferably metallic members.

The pair of vertical supports 40 adjacent the cab 27 are secured at their lower ends to the horizontal supports 50 and at the upper ends to a top support rail 60. The top support rail 60 has a vertical section extending perpendicular to the horizontal supports 50 and an angled segment extending from the distal portion of the vertical section. Adjacent the tail of the truck 28 is a bottom support rail 64 secured to the horizontal supports 50. The bottom support rail 64, likewise. has a vertical and angular segment.

A transparent sheet 62 is secured between the top support rail 60 and the bottom support rail 64 so that the sheet 62 is disposed at an acute angle relative to the load bed 26. The sheet 62 is secured to the rails 60 and 64 by screws or other fasteners. Alternatively, the sheet 62 can be secured to the vertical supports 40, thus eliminating the need for the top and bottom support rails 60, 64. The sheet 62 is a transparent plastic material which enables the advertising display 22 to be readily seen, yet shielded from the environment. To prevent water leakage beneath the sheet 62, weather stripping is placed between the underside of the top support rail 60 and edges of the sheet 62. To cover and enclose the sides of the advertising display 22, side panels 32 are secured to the open sides of the frame 24. The side panels 32 are made from aluminum or like weather-resistant materials.

Figure 3:
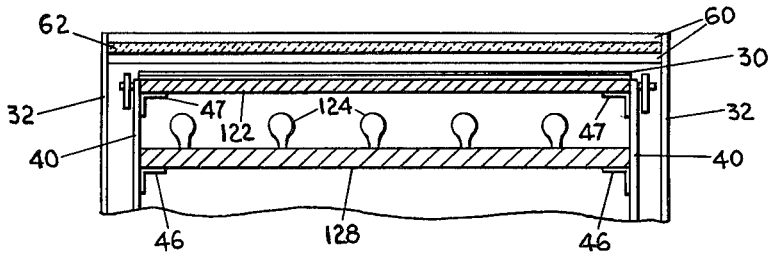
FIG. 3 is a sectional view along line 3—3 of FIG. 2.

As best seen in FIGS. 2 and 3, the advertising display 22 comprises an advertising medium formed from a roll 31 of flexible material 30 which is supported between a first spool member 74 and a second spool member 78. The lead edge of the roll 31 of material 30 passes through a guide member 76 disposed between the spool members 74 and 78. These spools and guide members are journalled in the frame 24 and provide a means for displaying advertising messages at a downward slope relative to the load bed 26 of the truck 28. The material 30 can be paper or cloth printed with several sets of advertising messages.

Figure 4:
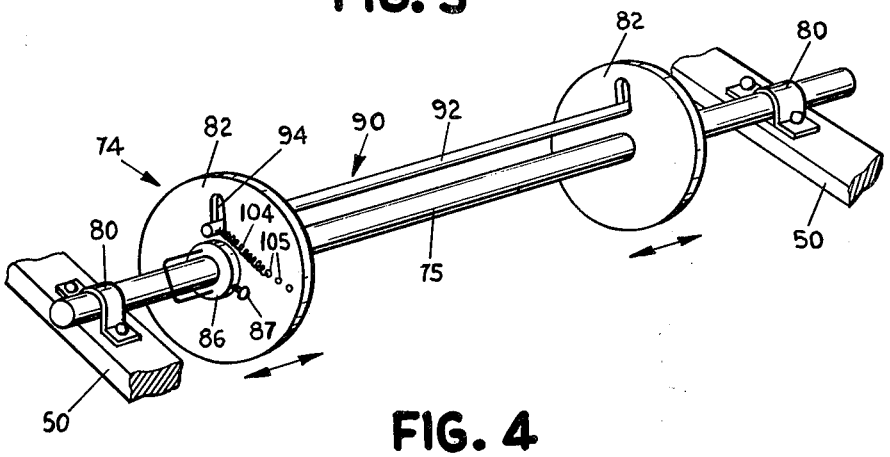
FIG. 4 is a perspective view of the spool means of the invention.
Figure 7:
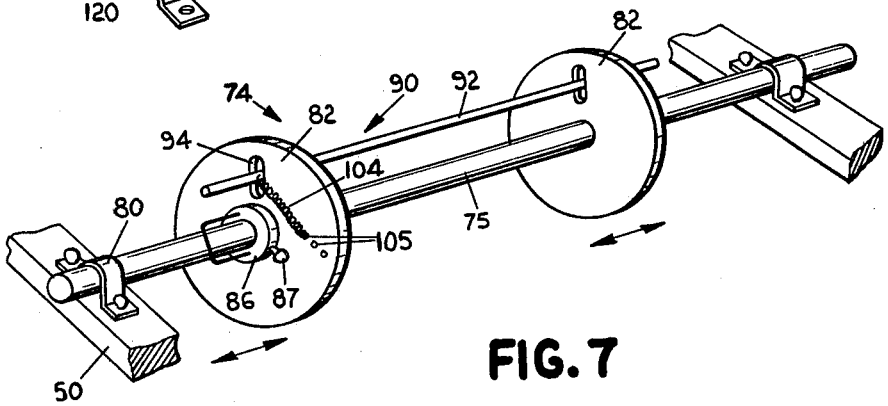
FIG. 7 is a perspective view of the spool means adjusted to accommodate a different roll of advertisement material.

The spool member 74, as best seen in FIGS. 4 and 7, is journalled in the horizontal supports 50 by hinged, U-shaped mounting brackets 80 which are secured to the supports 50. The spool member 74 includes a spool bar 75 and two adjustable discs 82 which are axially mounted and spaced apart a selected distance to accommodate the width of the advertising material 30 mounted thereon. The ends of the spool bar 75 are received in the brackets 80. The adjustable discs 82 are secured along the spool bar 75 by collars 86 mounted on the spool bar 75 and fixed thereto by threaded screws 87 with wing-nut heads. The roll 31 of advertising material 30 is mounted to the spool bar 75 between the adjustable discs 82.

An adjustable tension device 90 is provided on the spool member 74 to secure the roll 31 of advertising material 30 to the spool bar 75. The tension device 90 comprises a tension bar 92 supported between the adjustable discs 82. The ends of the tension bar 92 are received in elongate slots 94 in the discs 82. A coil spring 104 is connected between the end of the tension bar 92 and one of a plurality of holes 105 in the disc 82. The tension bar 92 is movable within the slot 94 and exerts a desired tension against the roll 31 of advertising 30 due to the spring 104.

As best seen in FIG. 7, the spool member 74 can be adjusted in several ways to accommodate varying sizes of rolls 31 of advertising material 30. The discs 82 can be moved inwardly or outwardly along the axis of the spool bar 75 by loosening the threaded screws 87. Additionally, the tension exerted against the roll 31 of advertising material 30 can be varied depending upon the length of the spring 104 as fixed between the tension bar 92 and one of the holes 105.

Figure 6:
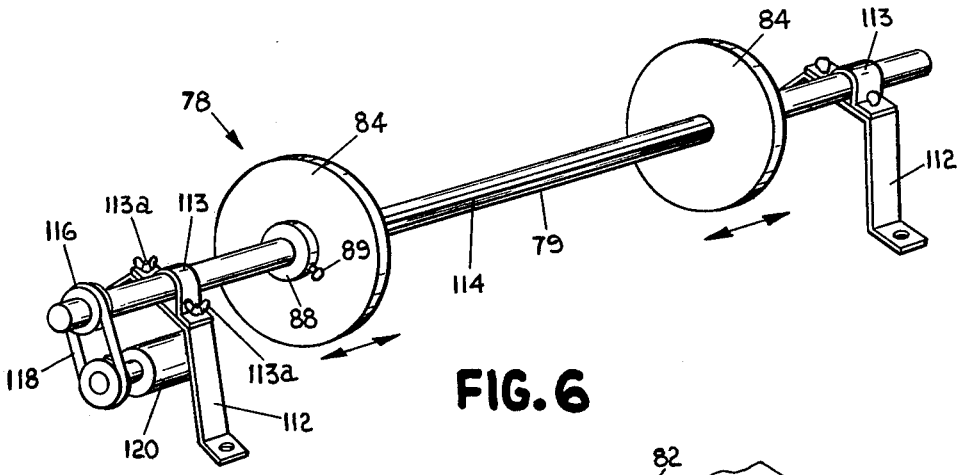
FIG. 6 is a perspective view of the roller means of the invention.

The second spool member 78, as seen in FIG. 6, is mounted to the load bed 26 at the tail end of the truck 28 by mounting brackets 112. The spool member 78 is constructed in the same fashion as the spool member 74. The spool member 78 includes a roller bar 79 having an elongate slot 114 therein. Two adjustable discs 84 are axially mounted on the bar 79. Collars 88 including threaded screws 89 with wing-nut heads fix the discs 84 to the roller bar 79. The roller bar 79 is secured to the mounting brackets 112 by U-bolts 113. The bracket 113 is smaller than the bar 79 and the pressure of the bracket 113 against the bar 79 creates frictional drag on the bar 79 to thereby hold the advertising material 30 taut between the bar 79 and the spool member 74. Screws **113*a* with wing-nut heads secure the bracket 113 to the bracket 112 to adjust the tension or frictional drag on the bar 79. The flexible material 30 is mounted to the bar 79 between the discs 84, with the end of the material 30 received in slot 114 in the roller bar 79**.

The roller bar 79 is driven manually or by a motor 120 so as to selectively diplay advertisements 30 on the roll 31. The drive mechanism includes a sprocket 116 connected to one end of the roller bar 79 and a belt 118 which connects a shaft of the motor 120 or a crank with the sprocket 116.

Figure 5:
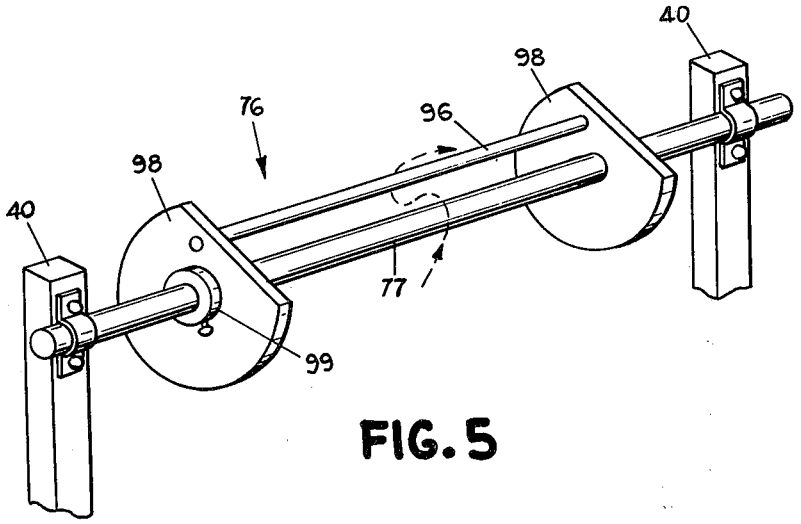
FIG. 5 is a perspective view of the guide means of the invention.

The guide member 76, as seen in FIG. 5, is fixedly secured to the vertical supports 40 by nuts and bolts. The guide member 76 includes a guide bar 77 which has two discs 98 axially mounted on the guide bar 77. Collars 99 including threaded screws with wing-nut heads adjustably secure the discs 98 in place along the guide bar 77. A guide member 96 is secured between the discs 98 so as to guide the advertising material 30 around the bar 77. The threading of the material 30 over the guide bar 77 and around the guide member 96 further tensions the advertising material 30 along the sloping rear wall of the frame.

The roller bar 79 is driven manually or by a motor 120 so as to selectively display advertisements 30 on the roll 31. The drive mechanism includes a sprocket 116 connected to one end of the roller bar 79 and a belt 118 which connects a shaft of the motor 120 or a crank with the sprocket 116.

A transparent bottom panel 122, shown in FIG. 2, is secured to the vertical supports 40 through angle irons 47 beneath the advertising material 30. Screws (not shown) are used to secure the angle irons 47 to the vertical supports 40 and the transparent panel 122. The bottom panel 122 provides a bottom support for the advertising material 30 and a back drop against which the advertising material 30 can be readily seen. The advertising 30 is therefore encased between the transparent sheet 62 and the bottom panel 122.

Beneath the bottom panel 122 are a plurality of light bulbs 124 mounted to a shelf 128. The light bulbs 124 provide backlighting for the advertising 30. The shelf 128 is secured to the vertical supports 40 through angle irons 46 and lies beneath the bottom panel 122. The light bulbs 124 can be connected to an electrical circuit 130 of the vehicle or alternatively to a separate power source 131.

Figure 11:
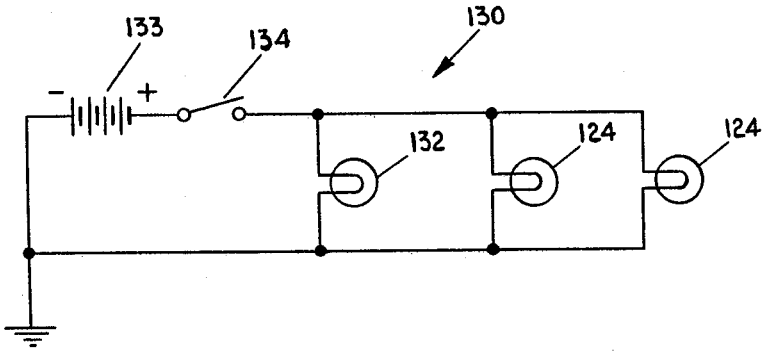
FIG. 11 is a schematic electrical diagram of the backlighting circuit used in the present invention.
Figure 12:
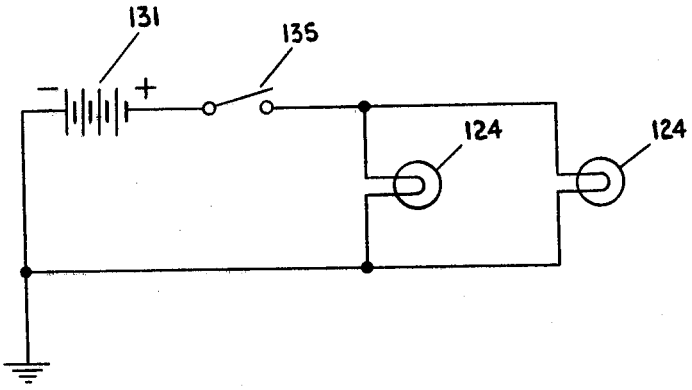
FIG. 12 is a schematic electrical diagram of an alternative backlighting circuit for the present invention.

FIGS. 11 and 12 show the alternative electrical circuits that may be employed. FIG. 11 shows the truck battery 133, connected in parallel with the light bulbs 124 and headlights 132 of the vehicle. A headlight switch 134 which, once engaged, completes the electrical circuit 130. FIG. 12, alternatively, shows a separate power source 131 connected to the light bulbs 124, with a separate light switch 135 provided.

In operation, the advertising display 22 provides illuminated advertising 30 readily seen by people to the rear or to either side of the truck 28. The advertising material 30 is secured to the spool member 74 between the adjustable discs 82 which are adjusted to accommodate the width of the advertising 30. The collars 86 are then fixed in place to secure the discs 82. The advertising material 30 is then unrolled from the spool member 74 and the leading edge of the material 30 is brought up over the guide bar 77, beneath and then over the rod member 96 as shown by the dotted line in FIG. 5. The material 30 is then brought down between the transparent sheet 62 and the bottom panel 122 and secured in the slot 114 of the spool member 79. The adjustable tension device 90 on the spool member 74 is set with the appropriate tension to accommodate the size of the roll 31 of advertising 31. The advertising message on the material 30 is then changed by rotation of the roller bar 79 which is connected to the motor 120 by the sprocket 116 and the belt 118. The advertising message is back-lighted, if desired, by the light bulbs 124 which are turned on by the headlight switch 134 on the truck 28 or by the separate switch 135.

In an alternative embodiment (FIGS. 8, 9 and 10), a step-like arrangement of the advertising display 23 is provided. Frame 24, as described above, is used to mount the advertising 30 to the vehicle. In place of the spool, guide and roller members 74, 76 and 78, respectively, a plurality of prisim-shaped blocks 140 are mounted to the frame 24. Each block 140 is mounted to a shaft 142 which is rotatably secured to rails 144 mounted on the frame 24. The ends of the shafts 142 are received in U-shaped brackets 146 fixed to the rails 144.

Each block 140 has four faces 141. At the edges of each face 141 are guides 154 into which advertising material 30 is secured. The guides 154 are metal flanges secured to the block 140. The flanges overlie the edges of the advertising material 30 so as to retain the material 30 in the blocks 140.

Light bulbs 124 are mounted along the rails 144 to illuminate each face 141 of the blocks 140. As described above, either the headlight switch 134 or the separate light switch 135 may be provided to turn on the light bulbs 124, using the electrical circuits as seen in FIGS. 11 and 12 described above.

In order to rotate the blocks 140 and change the display 23, sprockets 148 are attached to one end of each shaft 142. Belts 150 interconnect each sprocket 148 so that the blocks 140 are driven simultaneously. A belt 150 is connected between one sprocket 148 and the drive shaft 142 of motor 120 to rotate the blocks 140.

In operation, a sheet of advertising 30 is slid into each face 141 of each block 140 and secured thereon by the guides 154. When the motor 120 is turned on, the shaft 142 and blocks 140 are rotated to display the advertising material 30.

Figure 8:
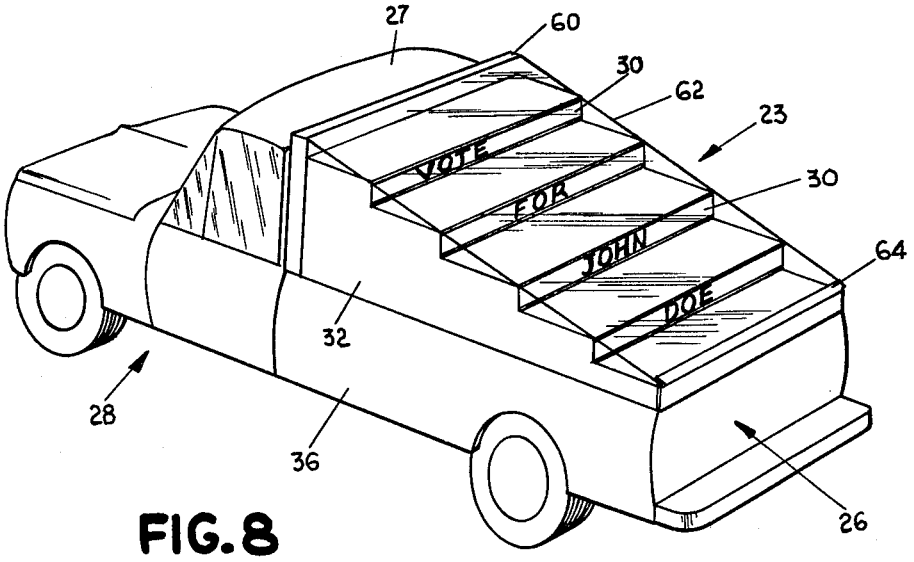
FIG. 8 is a perspective view of an alternative embodiment of the present invention.
Figure 9:
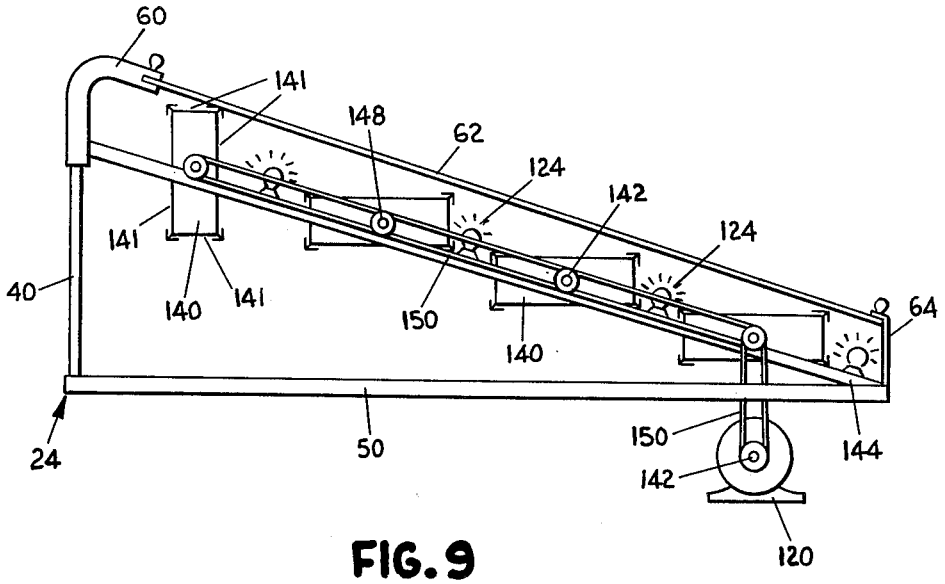
FIG. 9 is a perspective and sectional view of the alternative embodiment of the present invention.
Figure 10:
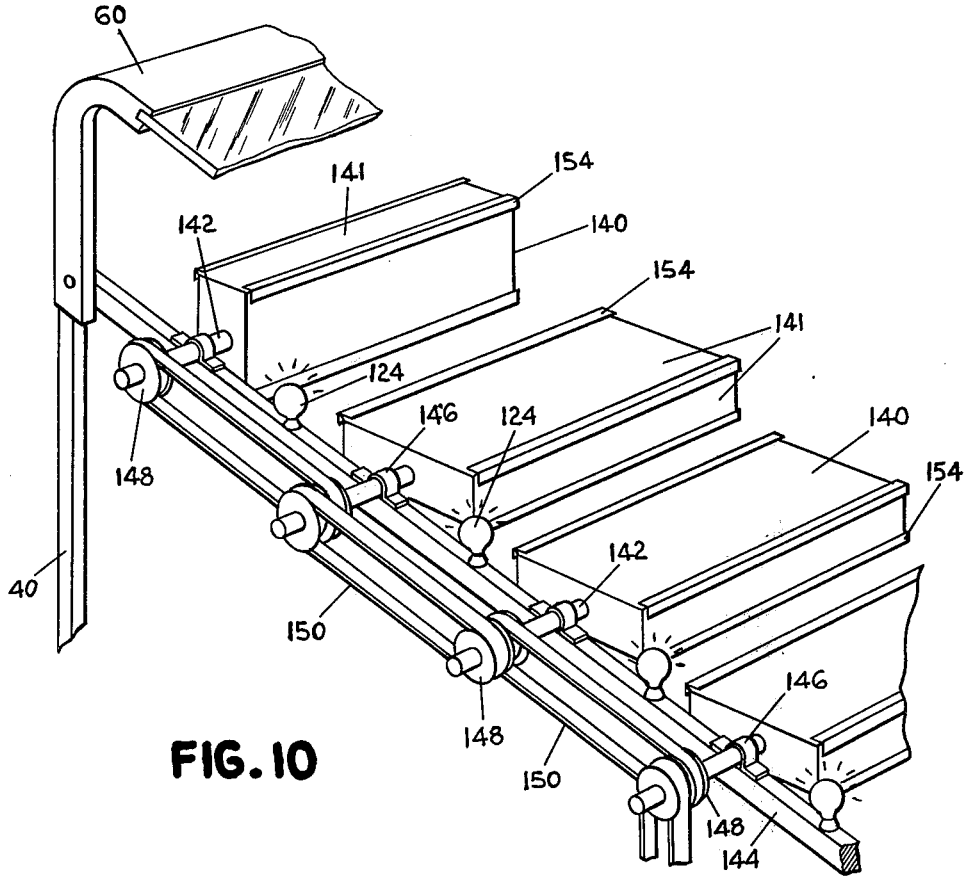
FIG. 10 is a perspective view of a rotatable block of the alternative embodiment of the present invention.

Although the embodiments of FIGS. 8–10 show the use of rectangularly shaped blocks, prism-shaped blocks with three or more sides can be used within the scope of the invention.

Thus, the use of the above-described advertising displays 22 and 23 provides a means for displaying advertising material 30 on the load bed 26 of a truck 28 which is readily visible from the street. The spool, guide and roller members 74, 76 and 78, respectively, provide an easy and convenient way of mounting the advertising 30 to the vehicle. The advertising displays 22 and 23 are readily constructed and taken apart. When the frame 24 is mounted to the truck 28, the load bed 26 remains accessible since the advertising displays 22 and 23 are positioned above the load bed 26. The alternative step arrangement of the removable advertising display 23 enables one to use sheets of advertising 30 instead of a roll 31 of advertising 30 and to easily replace such advertising.

While a particular embodiment of the invention has been shown, it will be understood that the invention is not limited thereto since modifications may be made by those skilled in the art, particularly in light of the foregoing teachings. It is therefore contemplated by the appended claims to cover any such modifications which constitute the essential features of this invention within the true spirit and scope of the invention.

The embodiments of the invention in which an exclusive property or privilege is claimed are defined as follows:

1. In combination with a pick-up truck having a cab and a rear deck with upstanding side walls,
   - a frame having a front, back and opposite sides, the front of the frame being adjacent the cab and the back of the frame being adjacent a back portion of the rear deck of the truck;
   - means for removably mounting the frame to the rear truck deck;
   - the front of the frame extending upwardly to a height near the top of the cab and sides of the frame sloping downwardly and rearwardly to a height near the top of the truck deck side walls, thereby defining a sloping rear wall on the frame;
   - a medium bearing a plurality of advertising messages;
   - means for mounting said medium on the frame for display of one advertising message along the sloping rear wall of the frame so as to be visible from the rear of the truck; and
   - means for moving the medium within the frame to sequentially display different advertising messages.

2. The combination of claim 1 and further comprising a transparent sheet of material mounted along the sloping rear wall of the frame providing a protective cover for the advertising medium.

3. The combination of claim 1 wherein the removable mounting means comprises means to bolt the frame opposite sides to the side walls of the vehicle.

4. The combination of claim 1 and further comprising means on the frame for illuminating the advertising medium presented along the sloping rear wall.

5. The combination of claim 1 wherein the advertising medium comprises a roll of flexible material;

said mounting means comprises a first spool journaled in said frame and gripping one end of said roll, a second spool journaled in said frame and gripping a second end of said roll of flexible material;

means for guiding said roll of advertising material between said spools and along the sloping rear wall of said frame; and the means for moving said medium comprises means for rotating at least one of said spools.

6. The combination of claim 5 and further comprising means for tensioning said flexible material at front and back portions of said sloping rear wall to retain said flexible material relatively taut along said sloping rear wall.

7. The combination of claim 6 and further comprising means on said frame beneath said roll of flexible material on said sloping rear wall for illuminating said roll of flexible material on said sloping rear wall.

8. The combination of claim 5 wherein the first spool comprises:

a spool bar;

two adjustable disc members slidably mounted at spaced-apart locations adjacent the side edges of said roll of advertising material; and means for securing each disc member to the spool bar.

9. The combination of claim 8 and further comprising journal means for rotatably supporting said spool bar in said frame and means for selectively adjusting the friction of the roll bar in the journal means to tension said roll of flexible material.

10. The combination of claim 9 wherein said guiding means comprises first and second guide bars rigidly mounted to a front portion of the frame in spaced-apart, parallel relationship;

two disc members slidable on said guide bar;

means for securing said disc members on said guide bars at selected locations therealong; and the roll of advertising material being threaded over and through said guide bars to tension said roll of advertising material.

11. The combination of claim 8 and further comprising radial slots in said discs in registry with each other;

a tension bar extending along the length of said spool bar and having an end positioned in each of said slots;

means to bias said tension bar towards said spool bar to maintain tension on the roll of advertising material wound around said spool bar.

12. The combination of claim 1 wherein said advertising medium comprises a plurality of trapezoidally shaped boxes providing a plurality of faces, each of which bears a portion of a different set of advertising messages;

said boxes being disposed horizontally between the sides of said frame;

said mounting means comprises means to journal each of said boxes in said frame at spaced locations parallel to the sloping rear wall thereof;

means for interconnecting the journals of said boxes; and means for selectively maintaining said boxes in a fixed position and for selectively rotating said boxes to sequentially present different sets of advertising messages.

13. The combination of claim 12 and further comprising means on said frame for illuminating rearwardly facing surfaces of said boxes.

* * * * *